US011445295B2

(12) United States Patent
Chen et al.

(10) Patent No.: US 11,445,295 B2
(45) Date of Patent: Sep. 13, 2022

(54) LOW-LATENCY SPEECH SEPARATION

(71) Applicant: Microsoft Technology Licensing, LLC, Redmond, WA (US)

(72) Inventors: Zhuo Chen, Woodinville, WA (US); Changliang Liu, Bothell, WA (US); Takuya Yoshioka, Bellevue, WA (US); Xiong Xiao, Bothell, WA (US); Hakan Erdogan, Sammamish, WA (US); Dimitrios Basile Dimitriadis, Bellevue, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 116 days.

(21) Appl. No.: 16/950,163

(22) Filed: Nov. 17, 2020

(65) Prior Publication Data

US 2021/0076129 A1 Mar. 11, 2021

Related U.S. Application Data

(63) Continuation of application No. 16/376,325, filed on Apr. 5, 2019, now Pat. No. 10,856,076.

(51) Int. Cl.

| | |
|---|---|
| ***H04R 3/00*** | (2006.01) |
| ***G10L 25/30*** | (2013.01) |
| ***H04R 1/40*** | (2006.01) |

(52) U.S. Cl.

CPC ..... *H04R 3/005* (2013.01); *G10L 25/30* (2013.01); *H04R 1/406* (2013.01)

(58) Field of Classification Search

None

See application file for complete search history.

(56) References Cited

U.S. PATENT DOCUMENTS

| | | | | |
|---|---|---|---|---|
| 2015/0071455 | A1* | 3/2015 | Tzirkel-Hancock | G10L 15/20 381/86 |
| 2019/0043491 | A1* | 2/2019 | Kupryjanow | G10L 21/0208 |
| 2020/0027451 | A1* | 1/2020 | Cantu | H04R 3/005 |

* cited by examiner

*Primary Examiner* — Paul W Huber

(74) *Attorney, Agent, or Firm* — Alleman Hall Creasman & Tuttle LLP

(57) ABSTRACT

A system and method include reception of a first plurality of audio signals, generation of a second plurality of beamformed audio signals based on the first plurality of audio signals, each of the second plurality of beamformed audio signals associated with a respective one of a second plurality of beamformer directions, generation of a first TF mask for a first output channel based on the first plurality of audio signals, determination of a first beamformer direction associated with a first target sound source based on the first TF mask, generation of first features based on the first beamformer direction and the first plurality of audio signals, determination of a second TF mask based on the first features, and application of the second TF mask to one of the second plurality of beamformed audio signals associated with the first beamformer direction.

19 Claims, 8 Drawing Sheets

LOW-LATENCY SPEECH SEPARATION

This is a continuation of U.S. patent application Ser. No. 16/376,325, entitled "LOW-LATENCY SPEECH SEPARATION", filed on Apr. 5, 2019, the entire contents of which are incorporated herein by reference for all purposes.

BACKGROUND

Speech has become an efficient input method for computer systems due to improvements in the accuracy of speech recognition. However, the conventional speech recognition technology is unable to perform speech recognition on an audio signal which includes overlapping voices. Accordingly, it may be desirable to extract non-overlapping voices from such a signal in order to perform speech recognition thereon.

In a conferencing context, a microphone array may capture a continuous audio stream including overlapping voices of any number of unknown speakers. Systems are desired to efficiently convert the stream into a fixed number of continuous output signals such that each of the output signals contains no overlapping speech segments. A meeting transcription may be automatically generated by inputting each of the output signals to a speech recognition engine.

DETAILED DESCRIPTION

The following description is provided to enable any person in the art to make and use the described embodiments. Various modifications, however, will remain apparent to those in the art.

Some embodiments described herein provide a technical solution to the technical problem of low-latency speech separation for a continuous multi-microphone audio signal. According to some embodiments, a multi-microphone input signal may be converted into a fixed number of output signals, none of which includes overlapping speech segments. Embodiments may employ an RNN-CNN hybrid network for generating speech separation Time-Frequency (TF) masks and a set of fixed beamformers followed by a neural post-filter. At every time instance, a beamformed signal from one of the beamformers is determined to correspond to one of the active speakers, and the post-filter attempts to minimize interfering voices from the other active speakers which still exist in the beamformed signal. Some embodiments may achieve separation accuracy comparable to or better than prior methods while significantly reducing processing latency.

Figure 1:
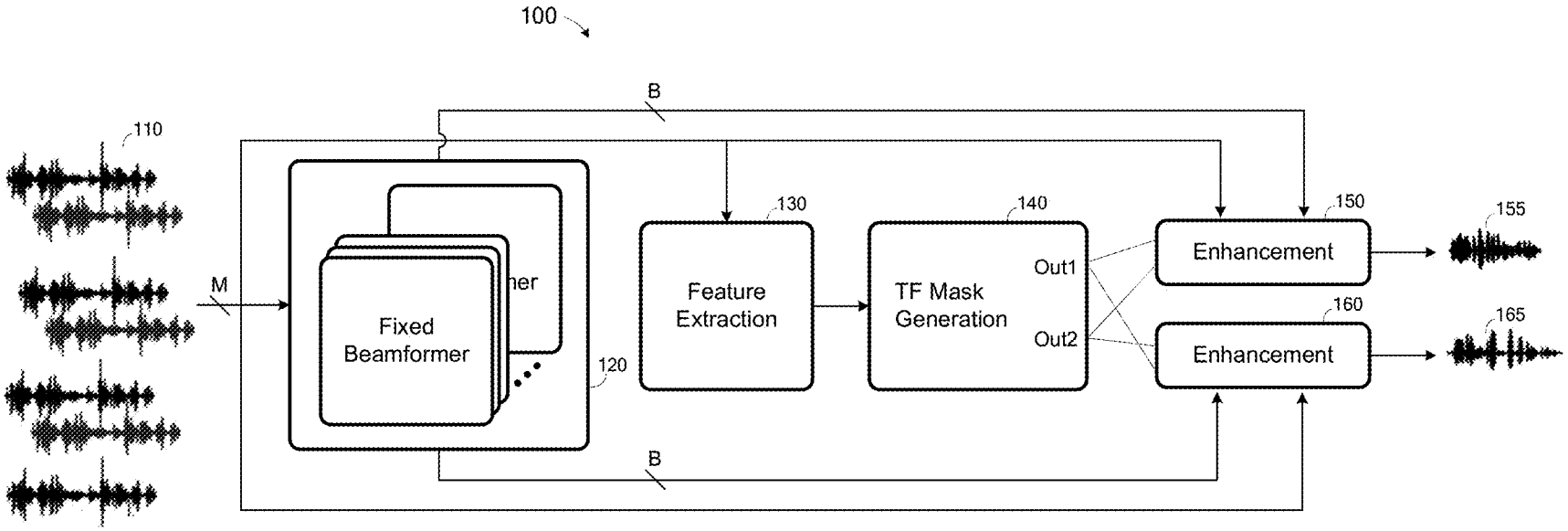
FIG. 1 is a block diagram of a system to separate overlapping speech signals from several captured audio signals according to some embodiments.

FIG. 1 is a block diagram of system 100 to separate overlapping speech signals based on several captured audio signals according to some embodiments. System 100 receives M (M>1) audio signals 110. According to some embodiments, signals 110 are captured by respective ones of seven microphones arranged in a circular array. Embodiments are not limited to any number of signals or microphones, or to any particular microphone arrangement.

Signals 110 are processed with a set of fixed beamformers 120. Each of fixed beamformers 120 may be associated with a particular focal direction. Some embodiments may employ eighteen fixed beamformers 120, each with a distinct focal direction separated by 20 degrees from its neighboring beamformers. Such beamformers may be designed based on the super-directive beamforming approach or the delay-and-sum beamforming approach. Alternatively, the beamformers may be learned from pre-defined training data so as to minimize an average loss function, such as the mean squared error between the beamformed and clean signals, over the training data is minimized.

Audio signals 110 are also received by feature extraction component 130. Feature extraction component 130 extracts first features from audio signals 110. According to some embodiments, the first features include a magnitude spectrum of one audio signal of audio signals 110 which was captured by a reference microphone. The extracted first features may also include inter-microphone phase differences computed between the audio signal captured by the reference microphone and the audio signals captured by each of the other microphones.

The first features are fed to TF mask generation component 140, which generates TF masks, each associated with either of two output channels (Out1 and Out2), based on the extracted features. Each output channel of TF mask generation component 140 represents a different sound source within a short time segment of audio signals 110. System 100 uses two output channels because three or more people rarely speak simultaneously within a meeting, but embodiments may employ three or more output channels.

A TF mask associates each TF point of the TF representations of audio signals 210 with its dominant sound source (e.g., Speaker1, Speaker2). More specifically, for each TF point, the TF mask of Out1 (or Out2) represents a probability from 0 to 1 that the speaker associated with Out1 (or Out2) dominates the TF point. In some embodiments, the TF mask of Out1 (or Out2) can take any number that represents the degree of confidence that the corresponding TF point is dominated by the speaker associated with Out1 (or Out2). If only one speaker is speaking, the TF mask of Out1 (or Out2) may comprise all 1's and the TF mask of Out2 (or Out1) may comprise all 0s. As will be described in detail below, TF mask generation component 140 may be implemented by a neural network trained with a mean-squared error permutation invariant training loss.

Output channels Out1 and Out2 are provided to enhancement components 150 and 160 to generate output signals 155 and 165 representing first and second sound sources (i.e., speakers), respectively. Enhancement component 150 (or 160) treats the speaker associated with Out1 (or Our2) as a target speaker and the speaker associated with Out2 (or Out1) as an interfering speaker and generates output signal 155 (or 165) in such a way that the output signal contains only the target speaker. In operation, each enhancement component 150 and 160 determines, based on the TF masks generated by TF mask generation component 140, the directions of the target and interfering speakers. Based on the target speaker direction, one of the beamformed signals generated by each of fixed beamformers 120 is selected. Each enhancement component 150 and 160 then extracts second features from audio signals 110, the selected beamformed signal, and the target and interference speaker directions to generate an enhancement TF mask based on the extracted second features. The enhancement TF mask is applied to (e.g., multiplied with) the selected beamformed signal to generate a substantially non-overlapped audio signal (155, 165) associated with the target speaker. The non-overlapped audio signals may then be submitted to a speech recognition engine to generate a meeting transcription.

Each component of system 100 and otherwise described herein may be implemented by one or more computing devices (e.g., computer servers), storage devices (e.g., hard or solid-state disk drives), and other hardware as is known in the art. The components may be located remote from one another and may be elements of one or more cloud computing platforms, including but not limited to a Software-as-a-Service, a Platform-as-a-Service, and an Infrastructure-as-a-Service platform. According to some embodiments, one or more components are implemented by one or more dedicated virtual machines.

Figure 2:
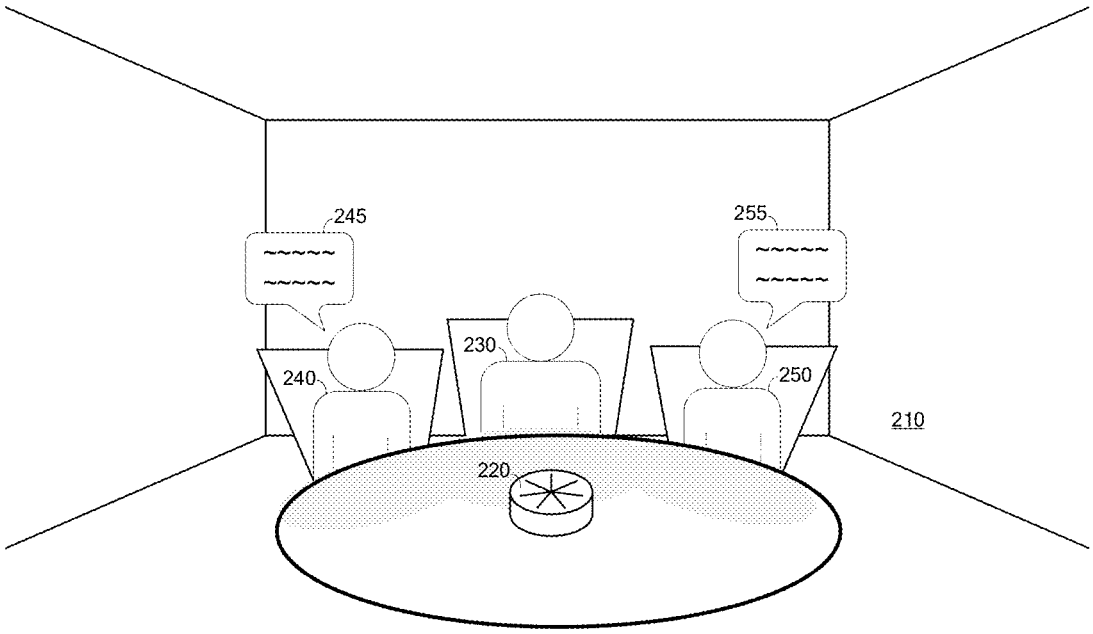
FIG. 2 depicts a conferencing environment in which several audio signals are captured according to some embodiments.

FIG. 2 depicts conference room 210 in which audio signals may be captured according to some embodiments. Audio capture system 220 is disposed within conference room 210 in order to capture multi-channel audio signals of sound source within room 210. Specifically, during a meeting, audio capture system 220 operates to capture audio signals representing speech uttered by participants 230, 240, and 250 within room 210. Embodiments may operate to produce two signals based on the multi-channel audio signals captured by system 220. When speech 245 of speaker 240 overlaps in time with speech 255 of speaker 250, an audio signal corresponding to speaker 240 may be output on a first channel and an audio signal corresponding to speaker 250 may be output on a second channel. Alternatively, the audio signal corresponding to speaker 240 may be output on the second channel and the audio signal corresponding to speaker 250 may be output on the first channel. If only one speaker is speaking at a given time, an audio signal corresponding to that speaker is output on one of the two output channels.

Figure 3:
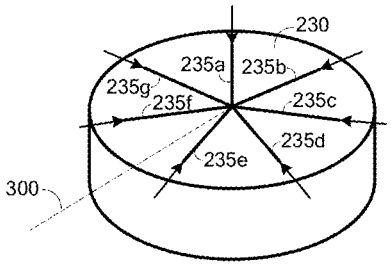
FIG. 3 depicts an audio capture device that records multiple audio signals according to some embodiments.

FIG. 3 is a view of audio capture system 220 according to some embodiments. Audio capture system 220 includes seven microphones 235*a*-235*g* arranged in a circular manner. In some embodiments, each microphone is omni-directional while in others, directional microphones may be used. Direction 300 is intended to represent one fixed beamformer direction according to some embodiments. For example, a fixed beamformer 120 associated with direction 300 receives signals from each of microphones 235*a*-235*g* and processes the signals to estimate a signal that arrives from a signal component direction 300.

Figure 4:
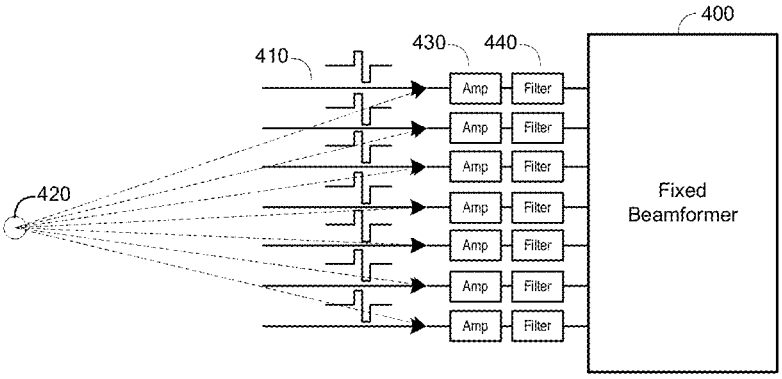
FIG. 4 depicts beamforming according to some embodiments.
Figure 5:
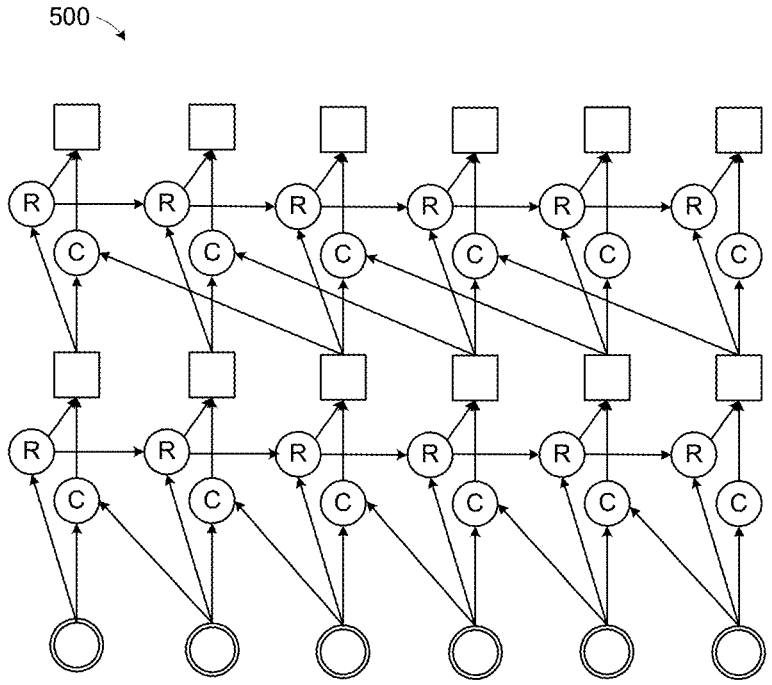
FIG. 5 depicts a unidirectional re-current neural network (RNN) and convolutional neural network (CNN) hybrid that generates TF masks according to some embodiments.

FIG. 4 illustrates beamforming by fixed beamformer 400 according to some embodiments. As shown, beamformer 400 receives seven independent signals represented by arrows 410, applies a specific linear time invariant filter to each signal to align signal components arriving from the direction of location 420 across the microphones, and sums the aligned signals to create a composite signal associated with the direction of location 420.

In some embodiments, TF mask generation component 140 is realized by using a neural network trained using permutation invariance training (PIT). One advantage of implementing component 140 as a neural network PIT, in comparison to other speech separation mask estimation schemes such as spatial clustering, deep clustering, and deep attractor networks, is that a PIT-trained network does not require prior knowledge of the number of active speakers. If only one speaker is active, a PIT-trained network yields zero-valued TF masks from any extra output channels. However, implementations of TF mask generation component 140 are not necessarily limited to a neural network trained with PIT.

A neural network trained with PIT can not only separate speech signals for each short time frame but can also maintain consistent order of output signals across short time frames. This results from penalization during training if the network changes the output signal order at some middle point of an utterance.

FIG. 3 depicts a hybrid of a unidirectional recurrent neural network (RNN) and a convolutional neural network (CNN) of a TF mask generator according to some embodiments. "R" and "C" represent recurrent (e.g., Long Short-Term Memory (LSTM)) nodes and convolution nodes, respectively. Square nodes perform splicing, while double circles represent input nodes. The temporal acoustic dependency in the forward direction is modeled by the LSTM network. On the other hand, the CNN captures the backward acoustic dependency. Dilated convolution may be employed to efficiently cover a fixed length of future acoustic context. According to some embodiments, TF mask generation component 140 consists of a projection layer including 1024 units, two RNN-CNN hybrid layers, and two parallel fully-connected layers with sigmoid nonlinearity. The activations of the final layer are used as TF masks for speech separation. Using two RNN-CNN hybrid layers, four ($=N_{LF}$) future frames are utilized, with a frame shift of 0.016 seconds.

The above-described PIT-trained network assigns an output channel to each separated speech frame consistently across short time frames but this ordering may break down over longer time frames. For example, the network is trained on mixed speech segments of up to $T_{TR}$ (=10) seconds during the learning phase, so the resultant model does not necessarily keep the output order consistent beyond $T_{TR}$ seconds. In addition, a RNN's state values tend to saturate when exposed to a long feature vector stream. Therefore, some embodiments refresh the state values periodically in order to keep the RNN working.

Figure 6:
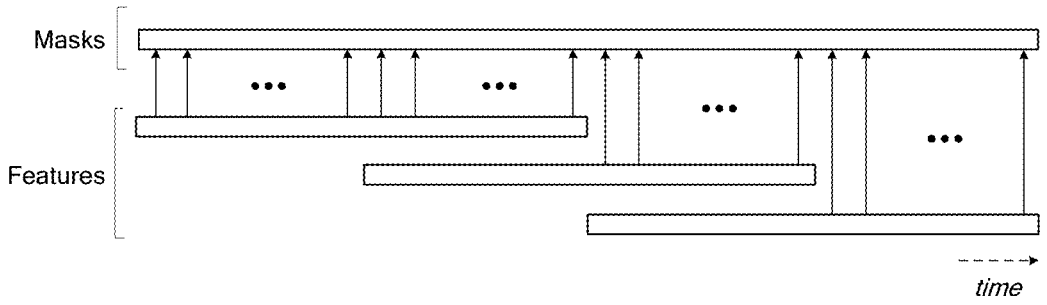
FIG. 6 depicts a double buffering scheme according to some embodiments.

FIG. 6 illustrates a double buffering scheme to reduce the processing latency according to some embodiments. Feature vectors are input to the network for $T_W$(=2.4) seconds. Because the model uses a fixed length of future context, the output TF masks may be obtained with a limited processing latency. Halfway through processing the first buffer, a new buffer is started from fresh RNN state values. The new buffer is processed for another $T_W$ seconds. By using the TF masks generated for the first $T_W/2$-second half, the best output order for the second buffer, which keeps consistency with the first buffer, may be determined. More specifically, the order is determined so that the mean squared error is minimized between the separated signals obtained for the last half of the previous buffer and the separated signals obtained for the first half of the current buffer. Use of the double buffering scheme may allow continuous real-time generation of TF masks for a long stream of audio signals.

Figure 7:
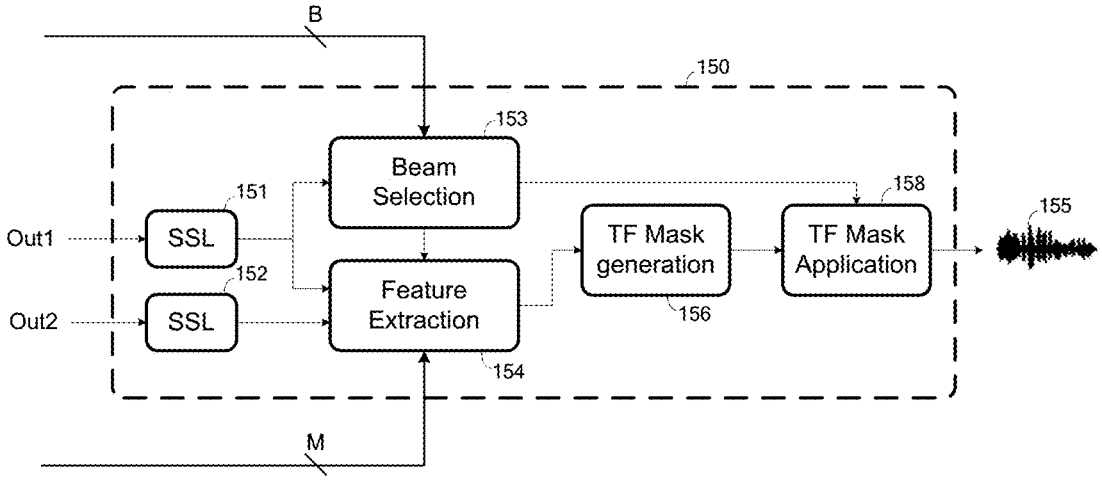
FIG. 7 is a block diagram of an enhancement module to enhance a beamformed signal associated with a target speaker according to some embodiments.

FIG. 7 is a detailed block diagram of enhancement component 150 according to some embodiments. Enhancement component 160 may be similarly configured. Initially, sound source localization component 151 determines a target speaker's direction based on a TF mask (i.e., Out1) associated with the target speaker, and sound source localization component 152 determines an interfering speaker's direction based on a TF mask (i.e., Out2) associated with the interfering speaker.

Feature extraction component 154 extracts features from original audio signals 110 based on the determined directions and the beamformed signal selected at beam selection component 153.TF mask generation component 156 generates a TF mask based on the extracted features. TF mask application component 158 applies the generated TF mask to the beamformed signal selected at beam selection component 153, corresponding to the determined target speaker direction, to generate output audio signal 155.

Sound source localization components 151 and 152 estimate the target and interference speaker directions every $N_S$ frames, or $0.016N_S$ seconds when a frame shift is 0.016 seconds, according to some embodiments. For each of the target and interference directions, sound source localization may be performed based on audio signals 110 and the TF masks of frames $(n-N_W, n]$, where n refers to the current frame index. The estimated directions are used for processing the frames in $(n-N_M-N_S, n-N_M]$, resulting in a delay of $N_M$ frames. A "margin" of length $N_M$ may be introduced so that sound source localization leverages a small amount of future context. In some embodiments, $N_M$, $N_S$, and $N_W$ are set at 20, 10, and 50, respectively.

Sound source localization may be performed with maximum likelihood estimation using the TF masks as observation weights. It is hypothesized that each magnitude-normalized multi-channel observation vector, $z_{t,f}$, follows a complex angular Gaussian distribution as follows:

$$p(z_{t,f}|\omega)=0.5\pi^{-M}(M-1)!|B_{f,\omega}|^{-1}(z_{t,f}B_{f,\omega}^{-1}z_{t,f})^{-M}$$

where ω denotes an incident angle, M the number of microphones, and $B_{f,\omega}=(h_{f,\omega}h_{f,\omega}+\varepsilon I)$ with $h_{f,\omega}$, I, and ε being the steering vector for angle ω at frequency f, an M-dimensional identify matrix, and a small flooring value. Given a set of observations, $Z=\{z_{t,f}\}$, the following log likelihood function is to be maximized with respect to ω:

$$L(\omega)=\sum_{t,f} m_{t,f}\log p(z_{t,f}\,|\,\omega)$$

where ω can take a discrete value between 0 and 360 and $m_{t,f}$ denotes the TF mask provided by the separation network. It can be shown that the log likelihood function reduces to the following simple form:

$$L(\omega)=-\sum_{t,f} m_{t,f}\log\left(1-\left\|z_{t,f}^{H}h_{f,\omega}\right\|^2/(1+\varepsilon)\right)$$

L(ω) is computed for every possible discrete direction. For example, in some embodiments, it is computed for every 5 degrees. The ω value that results in the highest score is then determined as the target speaker's direction.

For each of the target and interference beamformer directions, feature extraction component 154 calculates a directional feature for each TF bin as a sparsified version of the cosine distance between the direction's steering vector and the multi-channel microphone array signal 110. Also extracted are the inter-microphone phase difference of each microphone for the direction, and a TF representation of the beamformed signal associated with the direction. The extracted features are input to TF mask generation component 156.

TF mask generation component 156 may utilize a direction-informed target speech extraction method such as that proposed by Z. Chen, X. Xiao, T. Yoshioka, H. Erdogan, J. Li, and Y. Gong in "Multi-channel overlapped speech recognition with location guided speech extraction network," *Proc. IEEE Worksh. Spoken Language Tech.,* 2018. The method uses a neural network that accepts the features computed based on the target and interference directions to focus on the target direction and give less attention to the interference direction. According to some embodiments, component 156 consists of four unidirectional LSTM layers, each with 600 units, and is trained to minimize the mean squared error of clean and TF mask-processed signals.

Figure 8:
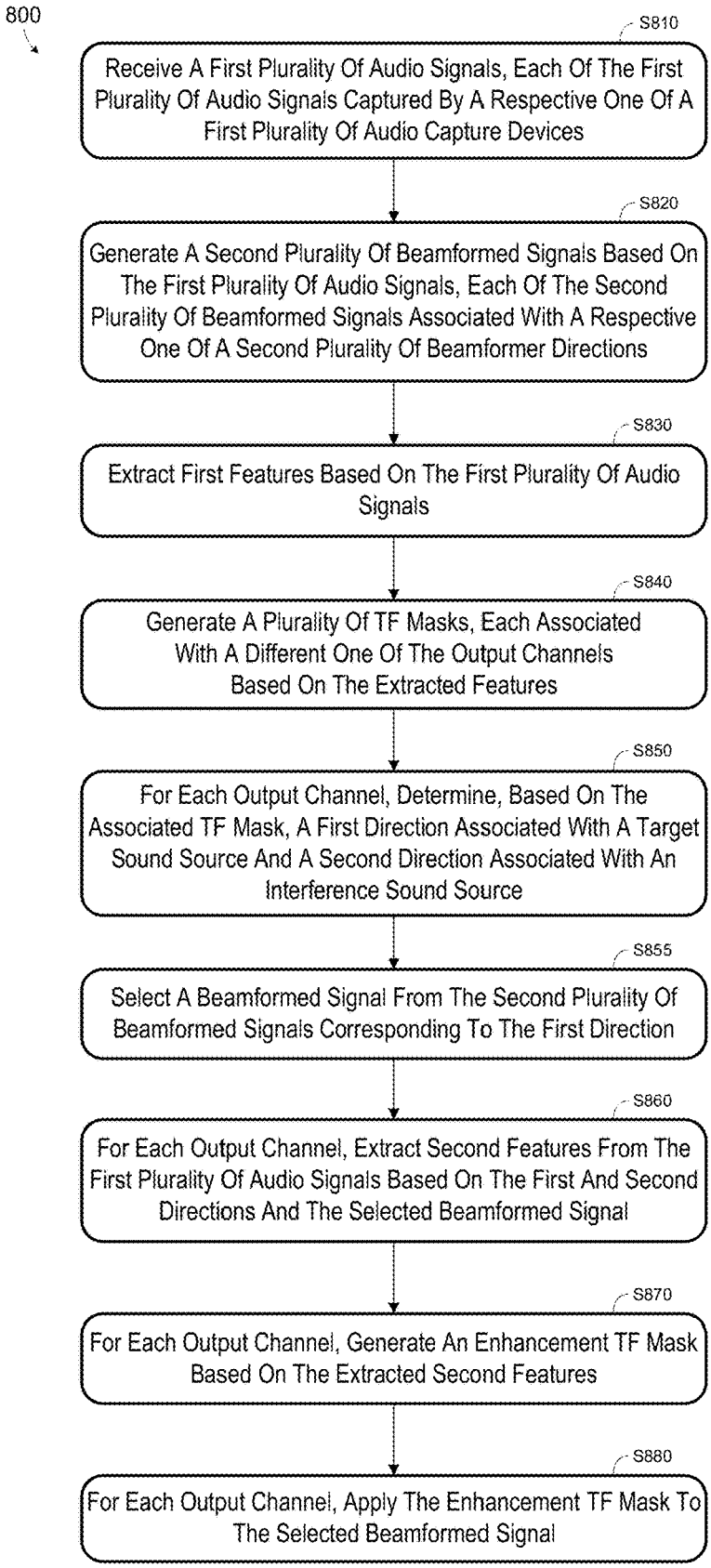
FIG. 8 is a flow diagram of a process to separate overlapping speech signals from several captured audio signals according to some embodiments.

FIG. 8 is a flow diagram of process 800 according to some embodiments. Process 800 and the other processes described herein may be performed using any suitable combination of hardware and software. Software program code embodying these processes may be stored by any non-transitory tangible medium, including a fixed disk, a volatile or non-volatile random access memory, a DVD, a Flash drive, or a magnetic tape, and executed by any number of processing units, including but not limited to processors, processor cores, and processor threads. Embodiments are not limited to the examples described below.

Initially, a first plurality of audio signals are received at S810. The first plurality of audio signals is captured by an audio capture device equipped with multiple microphones. For example, S810 may comprise reception of a multi-channel audio signal from a system such as system 220.

At S820, a second plurality of beamformed signals is generated based on the first plurality of audio signals. Each of the second plurality of beamformed signals is associated with a respective one of a second plurality of beamformer directions. S820 may comprise processing of the first plurality of audio signals using a set of fixed beamformers, with each of the fixed beamformers corresponding to a respective direction toward which it steers the beamforming directivity.

First features are extracted based on the first plurality of audio signals at S830. The first features may include, for example, inter-microphone phase differences with respect to a reference microphone and a spectrogram of one channel of the multi-channel audio signal. TF masks, each associated with one of two or more output channels, is generated at S840 based on the extracted features.

Next, at S850, a first direction corresponding to a target speaker and a second direction corresponding to a second speaker are determined based on the TF masks generated for the output channels. At S855, one of the second plurality of beamformed signals which corresponds to the first direction is selected.

Second features are extracted from the first plurality of audio signals at S860 for each output channel based on the first and second directions determined for the output channel. An enhancement TF mask is then generated at S870 for each output channel based on the second features extracted for the output channel. The enhancement TF mask of each output channel is applied at S880 to the selected beamformed signal. The enhancement TF mask is intended to de-emphasize an interfering sound source which might be present in the selected beamformed signal to which it is applied.

Figure 9:
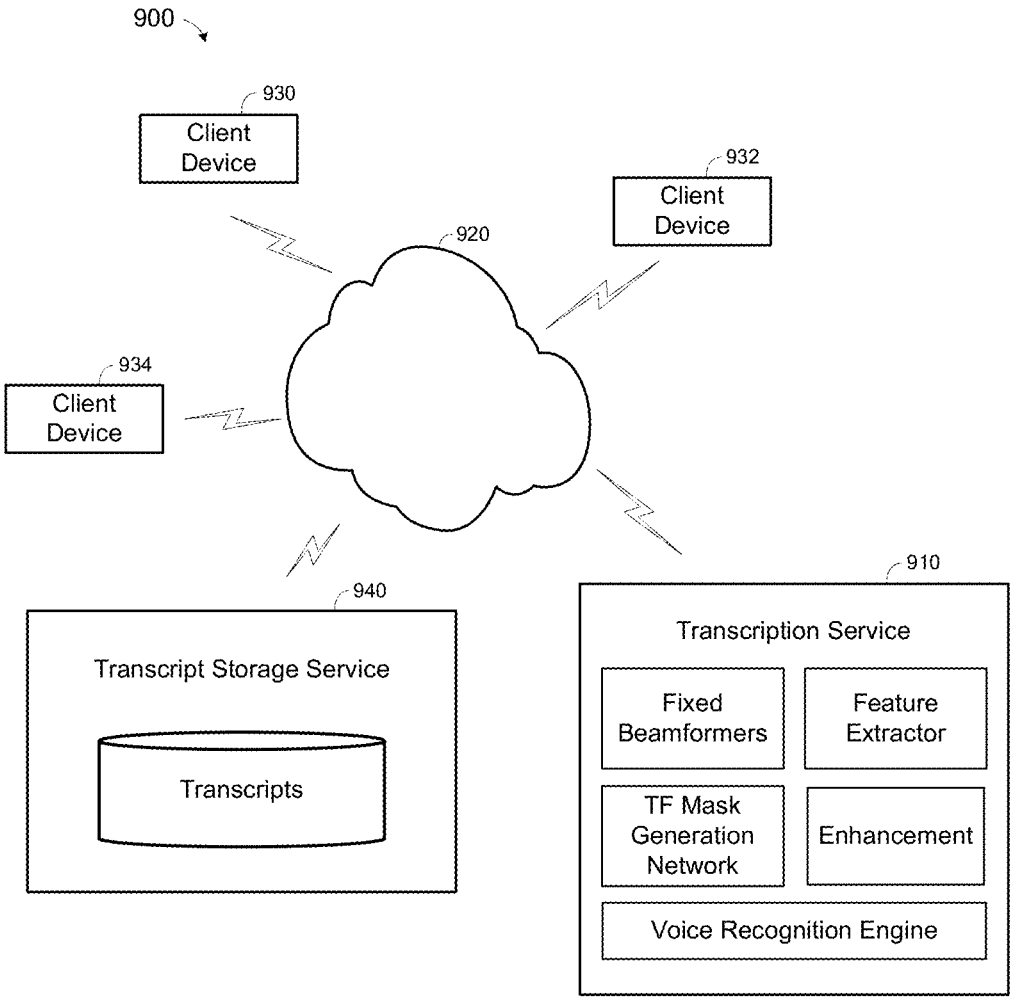
FIG. 9 is a block diagram of a cloud computing system providing speech separation and recognition according to some embodiments.

FIG. 9 illustrates distributed system 900 according to some embodiments. System 900 may be cloud-based and components thereof may be implemented using on-demand virtual machines, virtual servers and cloud storage instances.

As shown, transcription service 910 may be implemented as a cloud service providing transcription of multi-channel audio signals received over cloud 920. The transcription service may implement speech separation to separate overlapping speech signals from the multi-channel audio voice signals according to some embodiments.

One of client devices 930, 932 and 934 may capture a multi-channel directional audio signal as described herein and request transcription of the audio signal from transcription service 910. Transcription service 910 may perform speech separation and perform voice recognition on the separated signals to generate a transcript. According to some embodiments, the client device specifies a type of capture system used to capture the multi-channel directional audio signal in order to provide the geometry and number of capture devices to transcription service 910. Transcription service 910 may in turn access transcript storage service 940 to store the generated transcript. One of client devices 930, 932 and 934 may then access transcript storage service 940 to request a stored transcript.

Figure 10:
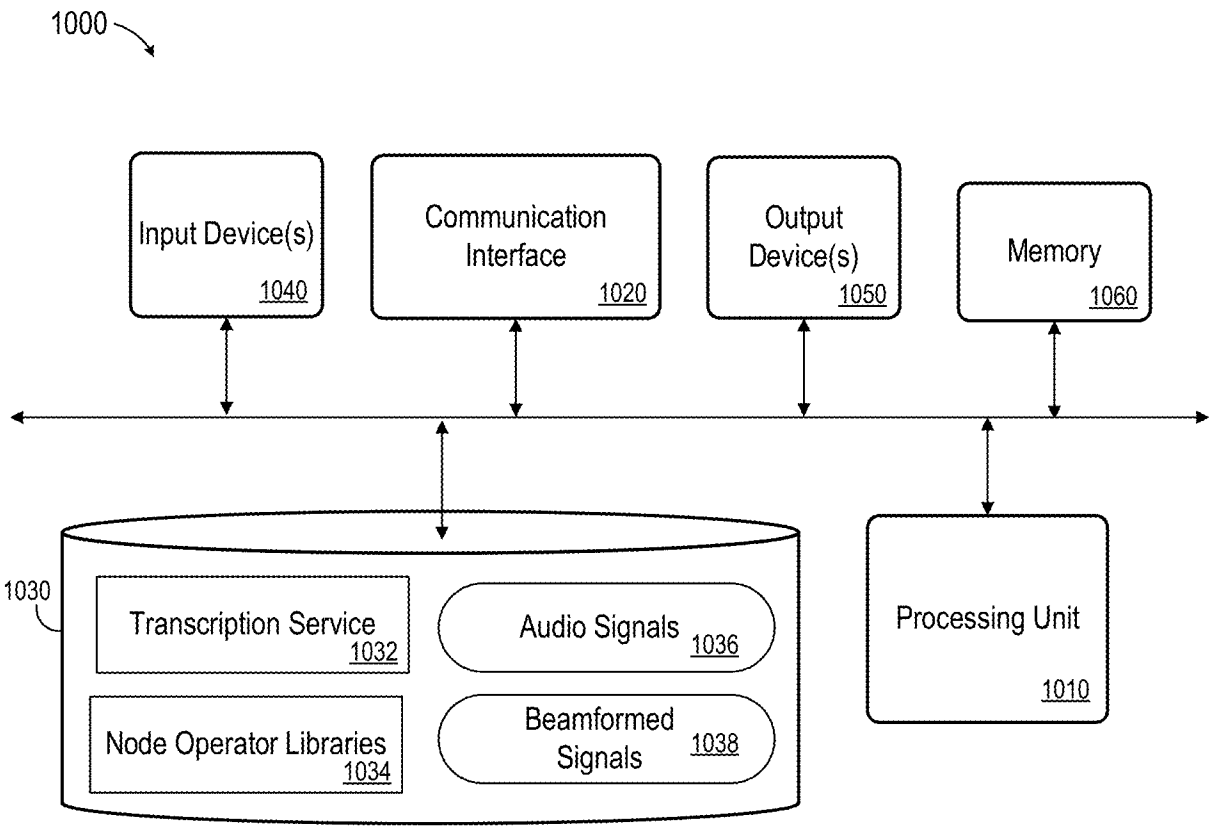
FIG. 10 is a block diagram of a system to separate overlapping speech signals from several captured audio signals according to some embodiments.

FIG. 10 is a block diagram of system 1000 according to some embodiments. System 1000 may comprise a general-purpose server computer and may execute program code to provide a transcription service and/or speech separation service as described herein. System 1000 may be implemented by a cloud-based virtual server according to some embodiments.

System 1000 includes processing unit 1010 operatively coupled to communication device 1020, persistent data storage system 1030, one or more input devices 1040, one or more output devices 1050 and volatile memory 1060. Processing unit 1010 may comprise one or more processors, processing cores, etc. for executing program code. Communication interface 1020 may facilitate communication with external devices, such as client devices, and data providers as described herein. Input device(s) 1040 may comprise, for example, a keyboard, a keypad, a mouse or other pointing device, a microphone, a touch screen, and/or an eye-tracking device. Output device(s) 1050 may comprise, for example, a display (e.g., a display screen), a speaker, and/or a printer.

Data storage system 1030 may comprise any number of appropriate persistent storage devices, including combinations of magnetic storage devices (e.g., magnetic tape, hard disk drives and flash memory), optical storage devices, Read Only Memory (ROM) devices, etc. Memory 1060 may comprise Random Access Memory (RAM), Storage Class Memory (SCM) or any other fast-access memory.

Transcription service 1032 may comprise program code executed by processing unit 1010 to cause system 1000 to receive multi-channel audio signals and provide two or more output audio signals consisting of non-overlapping speech as described herein. Node operator libraries 1034 may comprise program code to execute functions of trained nodes of a neural network to generate TF masks as described herein. Audio signals 1036 may include both received multi-channel audio signals and two or more output audio signals consisting of non-overlapping speech. Beamformed signals 1038 may comprise signals generated by fixed beamformers based on input multi-channel audio signals as described herein. Data storage device 1030 may also store data and other program code for providing additional functionality and/or which are necessary for operation of system 1000, such as device drivers, operating system files, etc.

Each functional component described herein may be implemented at least in part in computer hardware, in program code and/or in one or more computing systems executing such program code as is known in the art. Such a computing system may include one or more processing units which execute processor-executable program code stored in a memory system.

The foregoing diagrams represent logical architectures for describing processes according to some embodiments, and actual implementations may include more or different components arranged in other manners. Other topologies may be used in conjunction with other embodiments. Moreover, each component or device described herein may be implemented by any number of devices in communication via any number of other public and/or private networks. Two or more of such computing devices may be located remote from one another and may communicate with one another via any known manner of network(s) and/or a dedicated connection. Each component or device may comprise any number of hardware and/or software elements suitable to provide the functions described herein as well as any other functions. For example, any computing device used in an implementation of a system according to some embodiments may include a processor to execute program code such that the computing device operates as described herein.

All systems and processes discussed herein may be embodied in program code stored on one or more non-transitory computer-readable media. Such media may include, for example, a hard disk, a DVD-ROM, a Flash drive, magnetic tape, and solid state Random Access Memory (RAM) or Read Only Memory (ROM) storage units. Embodiments are therefore not limited to any specific combination of hardware and software.

Those in the art will appreciate that various adaptations and modifications of the above-described embodiments can be configured without departing from the claims. Therefore, it is to be understood that the claims may be practiced other than as specifically described herein.

What is claimed is:

1. A computing system comprising:

one or more processing units to execute processor-executable program code to cause the computing system to:

receive a first plurality of audio signals;

determine a first beamformer direction associated with a first target sound source based on the first plurality of audio signals;

generate a second plurality of beamformed audio signals based on the first plurality of audio signals, each of the second plurality of beamformed audio signals associated with a respective one of a second plurality of beamformer directions;

generate first features based on the first beamformer direction and the first plurality of audio signals;

determine a Time Frequency (TF) mask based on the first features; and determine one of the second plurality of beamformed audio signals which is associated with the first beamformer direction;

apply the TF mask to the one of the second plurality of beamformed audio signals associated with the first beamformer direction.

2. A computing system according to claim 1, the one or more processing units to execute processor-executable program code to cause the computing system to:

determine a second beamformer direction associated with a second target sound source based on the based on the first plurality of audio signals;

generate second features based on the second beamformer direction and the first plurality of audio signals;

determine a second TF mask based on the second features;

determine a second one of the second plurality of beamformed audio signals associated with the second beamformer direction; and apply the second TF mask to the second one of the second plurality of beamformed audio signals associated with the second beamformer direction.

3. A computing system according to claim 2, the one or more processing units to execute processor-executable program code to cause the computing system to:

determine a third beamformer direction associated with a first interfering sound source based on the TF mask;

generate the first features based on one of the second plurality of beamformed audio signals associated with the first beamformer direction, one of the second plurality of beamformed audio signals associated with the third beamformer direction, and the first plurality of audio signals;

determine a fourth beamformer direction associated with a second interfering sound source based on the first plurality of audio signals; and generate the second features based on one of the second plurality of beamformed audio signals associated with the second beamformer direction, one of the second plurality of beamformed audio signals associated with the fourth beamformer direction, and the first plurality of audio signals.

4. A computing system according to claim 3, wherein the second plurality of beamformed audio signals are generated by a second plurality of fixed beamformers.

5. A computing system according to claim 1, wherein the second plurality of beamformed audio signals are generated by a second plurality of fixed beamformers.

6. A computing system according to claim 1, the one or more processing units to execute processor-executable program code to cause the computing system to:

generate second features based on the first plurality of audio signals; and generate a second TF mask by inputting the second features to a trained neural network, wherein determination of the first beamformer direction associated with the first target sound source is based on the second TF mask and the first plurality of audio signals.

7. A computing system according to claim 1, wherein the TF mask associates each TF point of the first plurality of audio signals with a probability that the target sound source is a dominant sound source of the TF point.

8. A computing system according to claim 1, wherein application of the TF mask to the one of the second plurality of beamformed audio signals associated with the first beamformer direction generates an audio signal associated with the target sound source, the one or more processing units to execute processor-executable program code to cause the computing system to:

perform speech recognition on the audio signal associated with the target sound source to generate a transcription.

9. A computing system according to claim 2, wherein application of the TF mask to the one of the second plurality of beamformed audio signals associated with the first beamformer direction generates an audio signal associated with the target sound source, and application of the second TF mask to the second one of the second plurality of beamformed audio signals associated with the second beamformer direction generates a second audio signal associated with the second target sound source, the one or more processing units to execute processor-executable program code to cause the computing system to:

perform speech recognition on the audio signal associated with the target sound source and the second audio signal associated with the second target sound source to generate a transcription.

10. A system comprising:

a first plurality of fixed beamformers to receive a first plurality of audio signals and to generate a first plurality of beamformed audio signals based on the first plurality of audio signals, each of the first plurality of beamformed audio signals associated with a respective one of a first plurality of beamformer directions;

a sound source localization component to determine a first beamformer direction associated with a first target sound source based on the first plurality of audio signals, and to determine one of the first plurality of beamformed audio signals which is associated with the first beamformer direction;

a feature extraction component to generate first features based on one of the first plurality of beamformed audio signals associated with the first beamformer direction and the first plurality of audio signals;

a Time Frequency (TF) mask generation network to generate a TF mask based on the first features; and a signal processing component to apply the TF mask to the one of the first plurality of beamformed audio signals associated with the first beamformer direction.

11. A system according to claim 10, the sound source localization component to determine a second beamformer direction associated with a second target sound source based on the based on the first plurality of audio signals and to determine a second one of the first plurality of beamformed audio signals associated with the second beamformer direction, the feature extraction component to generate second features based on the second beamformer direction and the first plurality of audio signals, the TF mask generation network determine a second TF mask based on the second features, and the signal processing component to apply the second TF mask to the second one of the first plurality of beamformed audio signals associated with the second beamformer direction.

12. A system according to claim 11, the sound source localization component to determine a third beamformer direction associated with a first interfering sound source based on the TF mask, and to determine a fourth beamformer direction associated with a second interfering sound source based on the first plurality of audio signals, the feature extraction component to generate the first features based on one of the first plurality of beamformed audio signals associated with the first beamformer direction, one of the first plurality of beamformed audio signals associated with the third beamformer direction, and the first plurality of audio signals, and the feature extraction component to generate the second features based on one of the first plurality of beamformed audio signals associated with the second beamformer direction, one of the first plurality of beamformed audio signals associated with the fourth beamformer direction, and the first plurality of audio signals.

13. A system according to claim 10, generate second features based on the first plurality of audio signals; and generate a second TF mask by inputting the second features to a trained neural network, wherein determination of the first beamformer direction associated with the first target sound source is based on the second TF mask and the first plurality of audio signals.

14. A system according to claim 10, wherein the TF mask associates each TF point of the first plurality of audio signals with a probability that the target sound source is a dominant sound source of the TF point.

15. A system according to claim 10, wherein application of the TF mask to the one of the first plurality of beamformed audio signals associated with the first beamformer direction generates an audio signal associated with the target sound source, the system further comprising:

a speech recognition component to perform speech recognition on the audio signal associated with the target sound source to generate a transcription.

16. A system according to claim 11, wherein application of the TF mask to the one of the first plurality of beamformed audio signals associated with the first beamformer direction generates an audio signal associated with the target sound source, and application of the second TF mask to the second one of the first plurality of beamformed audio signals associated with the second beamformer direction generates a second audio signal associated with the second target sound source, the system comprising:

a speech recognition component to perform speech recognition on the audio signal associated with the target sound source and the second audio signal associated with the second target sound source to generate a transcription.

17. A computer-implemented method comprising:

receiving a first plurality of audio signals;

determining a first beamformer direction associated with a first target sound source based on the first plurality of audio signals;

generating a second plurality of beamformed audio signals based on the first plurality of audio signals, each of the second plurality of beamformed audio signals associated with a respective one of a second plurality of beamformer directions;

generating first features based on the first beamformer direction and the first plurality of audio signals;

determining a Time Frequency (TF) mask based on the first features; and determining one of the second plurality of beamformed audio signals which is associated with the first beamformer direction;

applying the TF mask to the one of the second plurality of beamformed audio signals associated with the first beamformer direction.

18. A computer-implemented method according to claim 17, further comprising:

determining a second beamformer direction associated with a second target sound source based on the based on the first plurality of audio signals;

generating second features based on the second beamformer direction and the first plurality of audio signals;

determining a second TF mask based on the second features;

determining a second one of the second plurality of beamformed audio signals associated with the second beamformer direction; and applying the second TF mask to the second one of the second plurality of beamformed audio signals associated with the second beamformer direction.

19. A computer-implemented method according to claim 18, further comprising:

determining a third beamformer direction associated with a first interfering sound source based on the TF mask;

generating the first features based on one of the second plurality of beamformed audio signals associated with the first beamformer direction, one of the second plurality of beamformed audio signals associated with the third beamformer direction, and the first plurality of audio signals;

determining a fourth beamformer direction associated with a second interfering sound source based on the first plurality of audio signals; and generating the second features based on one of the second plurality of beamformed audio signals associated with the second beamformer direction, one of the second plurality of beamformed audio signals associated with the fourth beamformer direction, and the first plurality of audio signals.

* * * * *